US009721740B1

(12) United States Patent
Carpenter

(10) Patent No.: US 9,721,740 B1
(45) Date of Patent: Aug. 1, 2017

(54) ZERO MOMENT SWITCH MECHANISM

(71) Applicant: General Equipment and Manufacturing Company, Inc., Louisville, KY (US)

(72) Inventor: Scott Carpenter, Sellersburg, IN (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

(21) Appl. No.: 15/223,682

(22) Filed: Jul. 29, 2016

(51) Int. Cl.

| | |
|---|---|
| ***H01H 36/00*** | (2006.01) |
| ***H01H 11/04*** | (2006.01) |
| ***H01H 23/26*** | (2006.01) |
| ***H01H 23/24*** | (2006.01) |

(52) U.S. Cl.
CPC ..... *H01H 36/0073* (2013.01); *H01H 11/04* (2013.01); *H01H 23/24* (2013.01); *H01H 23/26* (2013.01)

(58) Field of Classification Search
CPC .... H01H 36/00; H01H 36/0073–36/02; H01H 23/00–23/30
USPC ..... 335/205–207; 200/553–563
See application file for complete search history.

(56) References Cited

U.S. PATENT DOCUMENTS 2,749,400 A * 6/1956 Chichester ..... H01H 23/162 200/453

* cited by examiner

*Primary Examiner* — Ramon M Barrera
(74) *Attorney, Agent, or Firm* — Marshall, Gerstein & Borun LLP

(57) ABSTRACT

A magnetically-triggered proximity switch includes an actuator assembly disposed within a switch body, and the actuator assembly includes an actuator body extending along an actuator axis. A primary contact and a secondary contact is each coupled to the actuator body and may be separated from a center contact along the actuator axis. The actuator assembly is pivotable between a first switch position and a second switch position about a pivot axis. In the first switch position, the center contact is in contact with a common contact and the first contact is in contact with a primary contact, thereby completing a circuit between a common arm and a primary arm. In the second switch position, the center contact is in contact with the common contact and the second contact is in contact with a secondary contact, thereby completing a circuit between the common arm and a secondary arm.

20 Claims, 5 Drawing Sheets

ZERO MOMENT SWITCH MECHANISM

FIELD OF THE DISCLOSURE

This disclosure relates generally to proximity switch, and more particularly, to an actuator for a proximity switch.

BACKGROUND

Magnetically-triggered proximity switches, also known as limit switches, are commonly used for linear position sensing. Typically, magnetically-triggered proximity switches include a sensor that is adapted to detect the presence of a target without physically contacting the target. Typically, the sensor may include a switching circuit mechanism enclosed within a switch body of the proximity switch, and the switching circuit mechanism typically includes a lever and contacts that are biased into a first position that closes a normally closed circuit. When the target, which generally includes a permanent magnet contained within a housing, passes within a predetermined range of the sensor, the magnetic flux generated by the target magnet triggers the switching circuit mechanism, thereby displacing the switching circuit mechanism into a second position in which the normally-closed circuit is opened and a normally-open circuit is closed. The closing of the normally-open circuit is detected by a processor, and a signal is sent to an operator or an automated operation system to indicate the presence of the target within the predetermined range of the sensor. The target may be secured to a displaceable element of a system, such as a valve stem of a control valve, and the sensor maybe secured to a stationary element of the system, such as a control valve body. When so configured, the sensor can detect when the displaceable element has changed positions (such as when a closure member coupled to the valve stem of the control valve has displaced from an open position to a closed position) and send a signal to alert the operator or the automated operation system.

The switching circuit mechanism typically includes a conducting component that moves or pivots relative to a stationary conducting component to close the normally-open circuit. This relative motion requires that a conductor connecting the moving component to the non-moving component be flexible during operation, and this flexible component is typically a copper braided material (known as a "pigtail."). Although effective in some applications, pigtails have several drawbacks. For example, pigtails are limited in size because the flexibility of the pigtail is a function of its length. That is, if the pigtail is too short, the pigtail will be too stiff to adequately flex during operation. Consequently, the pigtail may break or its stiffness may prevent the closing of the normally-open circuit. Also, because the pigtail is comprised of many thin conducting wires, the current the pigtail can conduct is limited. Consequently, there is a need for a switching circuit mechanism that overcomes the problems of the pigtail by eliminating the need for a continuously flexing conductor to connect the moving and non-moving components of the switching circuit mechanism while also not limiting the amount of current that is able to flow through the switching circuit mechanism.

BRIEF SUMMARY OF THE DISCLOSURE

A magnetically-triggered proximity switch includes a switch body extending along a body axis from a first end to a second end, and a magnet is secured to a portion of the switch body. The magnetically-triggered proximity switch also includes a common arm having a first end and a second end, the first end being disposed within the switch body, and the first end including a common contact. The magnetically-triggered proximity switch further includes a primary arm having a first end and a second end, the first end being disposed within the switch body, and the first end including a primary contact. A secondary arm has a first end and a second end, the first end being disposed within the switch body, and the first end including a secondary contact. The magnetically-triggered proximity switch additionally includes an actuator assembly disposed within the switch body, and the actuator assembly includes an actuator body extending along an actuator axis from a first end to a second end. The actuator assembly also includes a center contact coupled to the actuator body and disposed along the actuator axis, and a center contact axis extends through a center point of the center contact. A first contact is coupled to the actuator body and disposed along the actuator axis, and a center point of the first contact is disposed a first distance from the center point of the center contact. A second contact is coupled to the actuator body and disposed along the actuator axis, and a center point of the second contact is disposed a second distance from the center point of the center contact. The actuator assembly is pivotable between a first switch position and a second switch position, the actuator assembly being pivotable about a pivot axis. In the first switch position, the center contact is in contact with the common contact and the first contact is in contact with the primary contact, thereby completing a circuit between the common arm and the primary arm. In the second switch position, the center contact is in contact with the common contact and the second contact is in contact with the secondary contact, thereby completing a circuit between the common arm and the secondary arm

DETAILED DESCRIPTION

Figure 1A:
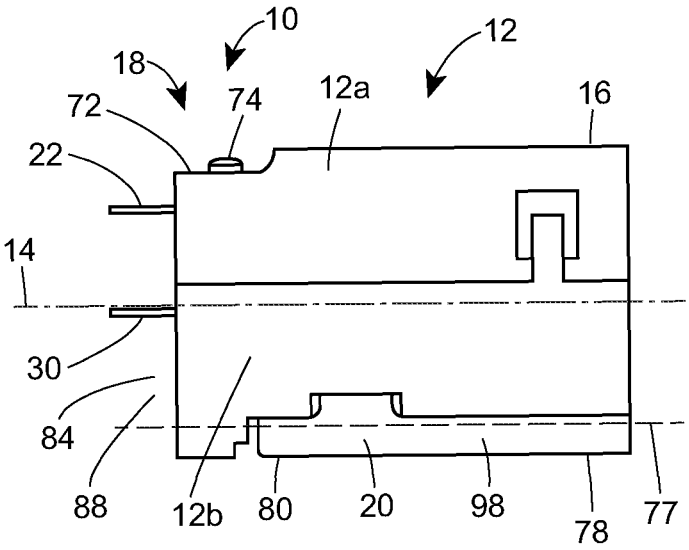
FIG. 1A is a side view of an embodiment of a magnetically-triggered proximity switch.
Figure 2:
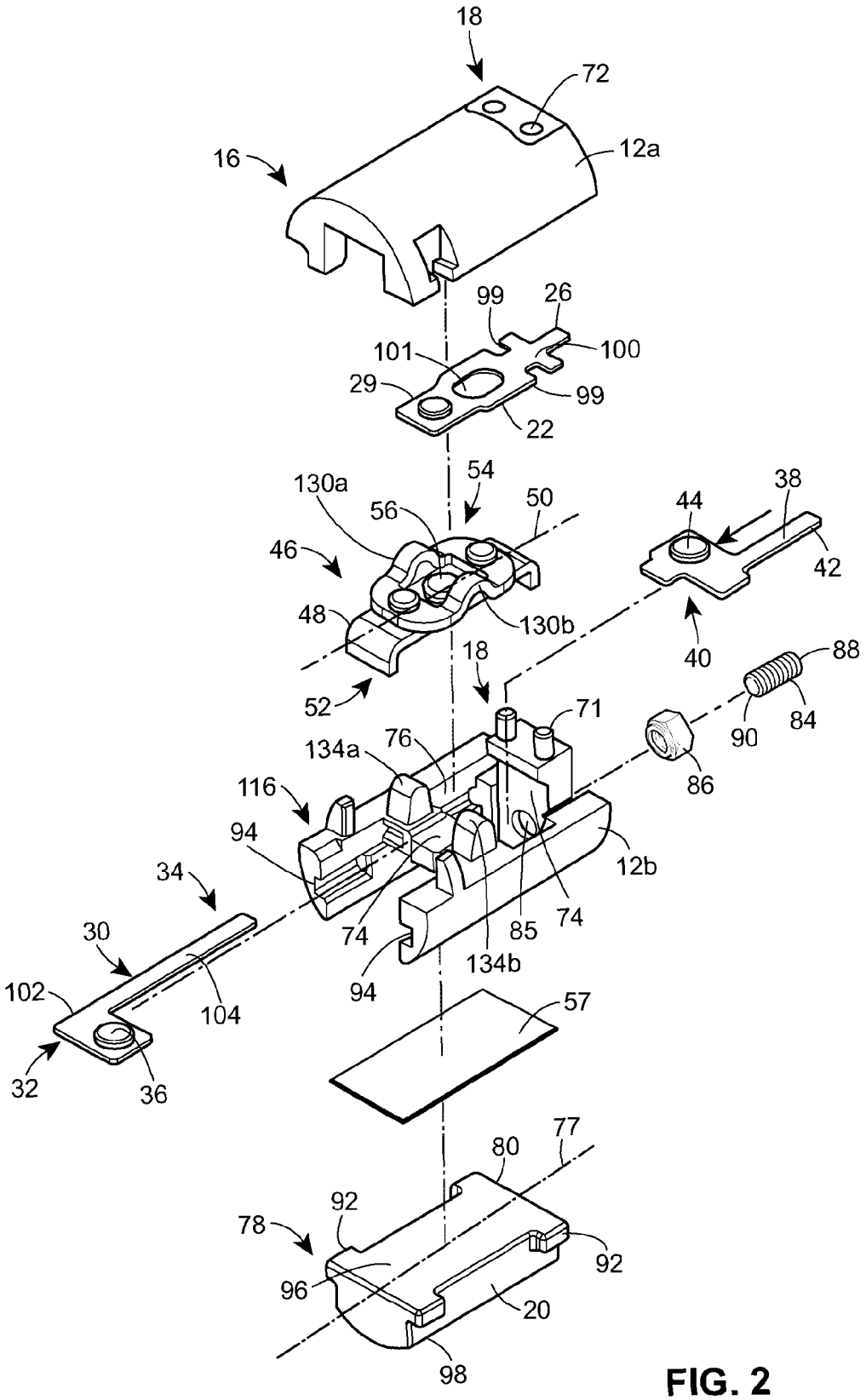
FIG. 2 is an exploded perspective view of the embodiment of the magnetically-triggered proximity switch of FIG. 1A.
Figure 3:
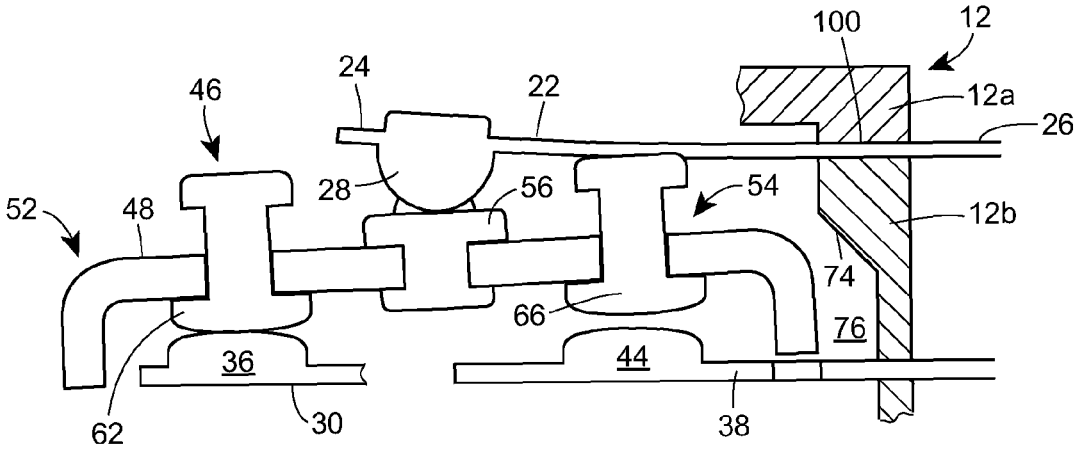
FIG. 3 is a side view of an embodiment of an actuator assembly (with the support member is removed for clarity) in a first switch position.

As illustrated in FIG. 1A, a magnetically-triggered proximity switch 10 includes a switch body 12 (which may include a first portion 12*a* and a second portion 12*b*) extending along a body axis 14 from a first end 16 to a second end 18, and a magnet 20 is secured to a portion of the switch body 12. Referring to FIGS. 2 and 3, the magnetically-triggered proximity switch 10 also includes a common arm 22 having a first end 24 and a second end 26, the first end 24 being disposed within the switch body 12. As illustrated in FIG. 3, the first end 24 includes a common contact 28. A primary arm 30 has a first end 32 and a second end 34 (illustrated in FIG. 2), and the first end 32 is disposed within the switch body 12. The first end 34 includes a primary contact 36. A secondary arm 38 has a first end 40 and a second end 42, and the first end 40 is disposed within the switch body 12. The first end 40 of the secondary arm 38 includes a secondary contact 44.

As illustrated in FIG. 2, the magnetically-triggered proximity switch 10 also includes an actuator assembly 46 disposed within the switch body 12, the actuator assembly 46 including an actuator body 48 extending along an actuator axis 50 from a first end 52 to a second end 54. A center contact 56 is coupled to the actuator body 48 and disposed along the actuator axis 50, and a center contact axis 58 extends through a center point 60 of the center contact 56. As illustrated in FIG. 6, a first contact 62 is coupled to the actuator body 48 and is disposed along the actuator axis 50. A center point 64 of the first contact 62 is disposed a first distance D1 (along the actuator axis 50) from the center point 60 of the center contact 56. A second contact 66 is coupled to the actuator body 50 and disposed along the actuator axis 50, and a center point 68 of the second contact 66 is disposed a second distance D2 (along the actuator axis 50) from the center point 60 of the center contact 56. The actuator assembly 46 is pivotable between a first switch position (illustrated in FIG. 3) and a second switch position (illustrated in FIG. 4), the actuator assembly 46 being pivotable about a pivot axis 70 (see FIGS. 5A, 5B, and 6) that may be normal to the actuator axis 50 and/or the body axis 14. In the first switch position of FIG. 3, the center contact 56 is in contact with the common contact 28 and the first contact 62 is in contact with the primary contact 36, thereby completing a circuit between the common arm 22 and the primary arm 30. In the second switch position of FIG. 4, the center contact 56 is in contact with the common contact 28 and the second contact 66 is in contact with the secondary contact 44, thereby completing a circuit between the common arm 22 and the secondary arm 38.

So configured, the magnetically-triggered proximity switch 10 has s single moving component, the actuator assembly 46. The common arm 22, by acting as a leaf spring, forces the common contact 28 into conducting engagement with the center contact 56 of the actuator assembly 46, and this force is directed through the pivot axis 70 of the actuator assembly 46. This force that passes through pivot axis 70 minimizes the moment needed to pivot the actuator assembly 46 from the first switch position to the second switch position when a target 136 (see FIG. 8) is moved within an operational range of the magnetically-triggered proximity switch 10. Consequently, a continuously-flexing component, such as a pigtail, is not required, and the size of the actuator assembly 46 or any other component is not limited by the stiffness of the continuously-flexing component. In addition, because current is not conducted through a braided conductor comprised of multiple thin conductors, current that passes through the circuit between the common arm 22 and the primary arm 30 and the circuit between the common arm 22 and the secondary arm 38 is not limited by a cross-sectional size of the conduction path through the actuator assembly 46.

Figure 1B:
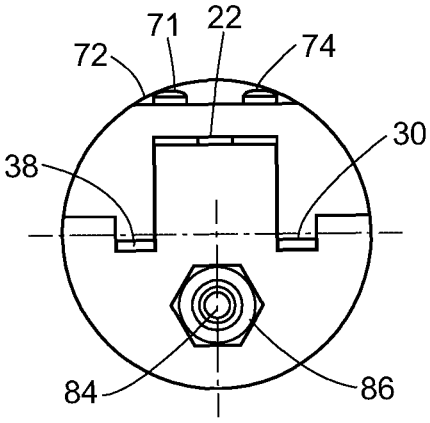
FIG. 1B is a rear view of the embodiment of the magnetically-triggered proximity switch of FIG. 1A.

Turning to the magnetically-triggered proximity switch 10 in more detail, the switch body 12 (including the first body half 12*a* and the second body half 12*b*, and any additional portions) may extend along the body axis 14 from the first end 16 to the second end 18, and the switch body 12 may cooperate with the magnet 20 to have a generally cylindrical shape having a circular cross-section, as illustrated in FIG. 1B. However, the switch body 12 may have any cross-sectional shape, such as a polygon or an oval, for example. Each of the first body portion 12*a* and the second body portion 12*b* may be formed from plastic and may be manufactured using conventional processes, such as injection-molding, for example. The plastic may be a high-temperature material that allows the switch body 12 to be exposed to environments that may damage conventional plastic materials. The first body portion 12*a* and the second body half 12*b* portion may be joined into a single switch body 12 by any method known in the art such as ultrasonic welding or by using an adhesive. For example, as illustrated in FIGS. 1A, 1B, and 2, a pair of pins 71 projecting from the second body portion 12*b* (adjacent the second end 18 of the switch body 12) may be received into corresponding bores 72 formed in the first body portion 12*a* (adjacent the second end 18 of the switch body 12), and an end of the pins 71 may be heat-staked to secure the first body portion 12*a* to the second body portion 12*b*. As illustrated in FIG. 3, the switch body 12 may have two or more internal surfaces 74 that define one or more internal cavities 76. For example, the two or more internal surfaces 74 may be formed on both of the first body portion 12*a* and the second body portion 12*b*, and these two or more internal surfaces 74 may define the one or more internal cavities 76 when the first body portion 12*a* is secured to the second body portion 12*b*. The switch body 12 may be hermetically sealed to protect the protect the proximity switch from water or dirt particles, and liquid or dirt particles may not be able to pass from an exterior of the switch body 12 into the one or more internal cavities 76.

As illustrated in FIG. 1A, the magnet 20 may be secured or coupled to a portion of the switch body 12. The magnet 20 may be a bias magnet that may provide a force on the actuator body 48 to bias the actuator assembly 46 in the first switch position. The magnet 20 may extend along a magnet axis 77 that may be parallel to the body axis 14 from a first end 78 of the magnet 20 to a second end 80 of the magnet 20. The first end 78 of the magnet 20 may generally extend to a point at or adjacent to the first end 16 of the switch body 12. The magnet 20 may include a top surface 96 that may be planar and an outside surface 98 that may be a portion of a cylinder. As illustrated in FIG. 2, a barrier 57, such as a piece of tape, may be disposed over the top surface 96 to protect the interface between the magnet 20 and the switch body 12. The magnet 20 may have two or more tabs 92 that may extend from the top surface 96 and may be received into corresponding slots 94 formed in the switch body 12 (or the second body portion 12*b*) to slidably couple the magnet 20 to the switch body 12. So configured, the magnet 20 may be adjustable about the magnet axis 77, and an adjustment mechanism 82 may be secured or coupled to the switch body 12 to adjust the position of the magnet 20 relative to the switch body 12. For example, the adjustment mechanism 82 may include a threaded rod 84 that extends through an aperture 85 (see FIG. 2) formed in a surface of the switch body 12 at or adjacent to the second end 18. A nut 86 an end of the aperture 85 may threadedly engage the threaded rod 84 such that turning an exterior end 88 of the threaded rod 84 extends or retracts a contact end 90 of the threaded rod 90 relative to the switch body 12, thereby providing a force on the second end 80 of the magnet 20 such that the magnet 20 can be positioned along the magnet axis 77 to properly bias the actuator assembly 46 in the first switch position.

Figure 4:
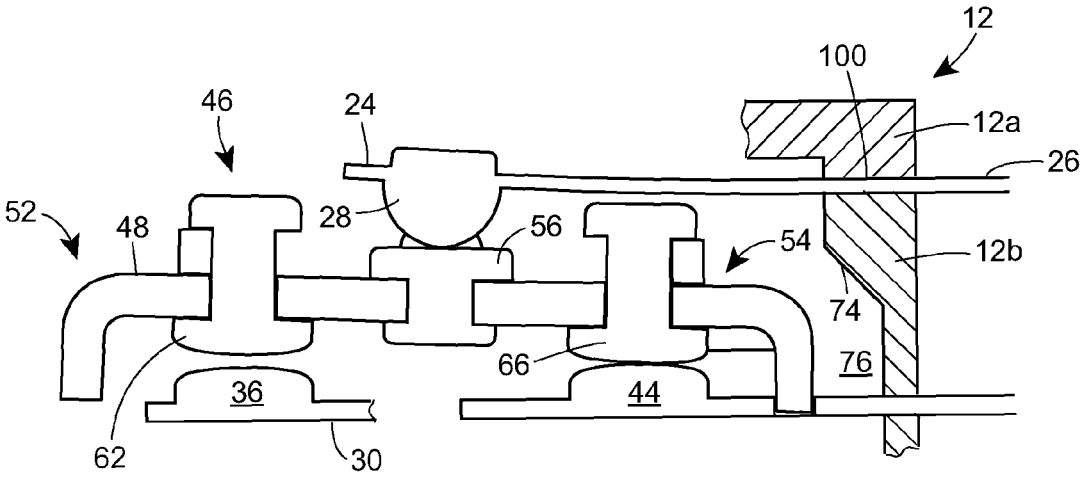
FIG. 4 is a side view of the embodiment of the actuator assembly of FIG. 3 in a second switch position.

Referring to FIGS. 2, 3, and 4, the magnetically-triggered proximity switch 10 includes the common arm 22, which is a common component of the circuit formed when the actuator assembly 46 is in the first switch position (illustrated in FIG. 3) and the second switch position (illustrated in FIG. 4). The common arm 22 may be a strip of a conducting metal, such as copper, a copper alloy or a steel alloy, and the common arm 22 may be formed from a stamping process. The first end 24 of the common arm 22 is disposed within the switch body 12. That is, the first end 24 of the common arm 22 is disposed within the one or more internal cavities 76 formed by the two or more internal surfaces 74 of the switch body 12. The second end 26 of the common arm 22 may be disposed outside of and/or exterior to the switch body 12. The first end 24 of the common arm 22 may extend (or may generally extend) towards the second end 26 of the common arm 22 along an axis that may be parallel to the body axis 14. The common contact 28 may be disposed at or adjacent to the first end 24 of the common arm 22, and the common contact 28 of the common arm 22 may face the center contact 56 of the actuator assembly 46. The common contact 28 may have the shape of a hemisphere or a dome, and a top portion of the common contact 28 may contact a portion of the center contact 56 of the actuator assembly 46 in a manner that will be described in more detail below. The common contact 28 may be made from a conductive metal, such as copper or a copper alloy, and the common contact 28 may be secured to the common arm 22 in any manner known in the art, such as soldering or mechanical fastening. For example, a portion of the common contact 28 may be disposed in an aperture formed adjacent to the first end 24 of the common arm 22. Alternatively, the common contact 28 may be integrally formed with the common arm 22 at or adjacent to the first end 24.

As illustrated in FIG. 3, the common arm 22 may be secured to a portion of the switch body 12 at a portion 100 of the common arm 22 between the first end 24 and the second end 26. The portion 100 of the common arm 22 may be between the second end 26 and a point midway between the first end 24 and the second end 26. So secured, the common arm 22 cannot displace relative to the switch body 12 in a direction parallel to the body axis 14. However, the common arm 22 may act as a leaf spring, and the first end 24 may displace in a direction normal to the body axis 14 if a force is applied to the first end 24 (or the common contact 28) in a direction normal to the body axis 14. In some embodiments, a pair of cut-outs 99 (illustrated in FIG. 2) may be disposed at, adjacent to, or within the portion 100, and each of a pair of cut-outs 99 may accept a corresponding one of the pair of pins 71 when the first body portion 12*a* is secured to the second body portion 12*b*. The portion 100 of the common arm 22 may be clamped between the first body portion 12*a* and the second body portion 12*b* to allow the first end 24 of the common arm 22 to deflect in a direction normal to the body axis 14 as described. One or more apertures 101 may be disposed in the common arm 22 (e.g., between the common contact 28 and the portion 100) to allow for a suitable deflection. This deflection will be described in more detail below.

Referring to FIGS. 2, 3, and 4, the magnetically-triggered proximity switch 10 also includes the primary arm 30, which is a component of the circuit formed when the actuator assembly 46 is in the first switch position of FIG. 3. The primary arm 30 may be a strip of a conducting metal, and may be made of the same material as the common arm 22. The first end 32 of the primary arm 30 is disposed within the switch body 12 (i.e., disposed within the one or more internal cavities 76 formed by the two or more internal surfaces 74 of the switch body 12). As illustrated in FIG. 2, the primary arm 30 may have a base portion 102 and an arm portion 102 that extends from the base portion 104. Specifically, the base portion 102 may extend from the first end 32 of the primary arm 30 towards the second end 34 of the primary arm 30 to a point about 10% to 50% of the total distance (along an axis parallel to the body axis 14) between the first end 32 of the primary arm 30 and the second end 34 of the primary arm 30. The arm portion 104 may extend from the base portion 102 to the second end 34 along an axis that is parallel to the body axis 14. A width (a distance normal to the direction of the body axis 14) of the base portion 102 may be greater than a width of the arm portion 104.

The primary contact 36 may be disposed at or adjacent to the first end 32 of the primary arm 30 on the base portion 102, and the primary contact 36 of the primary arm 30 may face and be generally aligned with the first contact 62 of the actuator assembly 46 such that the first contact 62 of the actuator assembly 46 engages or is in contact with the primary contact 36 in the first switch position of FIG. 3. The primary contact 36 may have the shape of a raised cylinder that extends from the base portion 102 in a direction normal to the body axis 14. The primary contact 36 may be made from a conductive metal, and may be made from the same material as the common contact 28. The primary contact 36 may be secured to the primary arm 30 in any manner known in the art, such as soldering or mechanical fastening. Alternatively, the primary contact 36 may be integrally formed with the primary arm 30 (e.g., with the base portion 102) at or adjacent to the first end 32 of the primary arm 30. As illustrated in FIG. 3, the primary arm 30 may be secured to a portion of the switch body 12 (e.g., a portion of the second portion 12*b*) such that the first contact 62 of the actuator assembly 46 engages or is in contact with the primary contact 36 of the primary arm 30 in the first switch position. So secured, the primary arm 30 cannot displace relative to the switch body 12.

Referring to FIGS. 2, 3, and 4, the magnetically-triggered proximity switch 10 also includes the secondary arm 38, which is a component of the circuit formed when the actuator assembly 46 is in the second switch position of FIG. 4. The secondary arm 38 may be a strip of a conducting metal, and may be made of the same material as the common arm 22. The first end 40 of the secondary arm 38 is disposed within the switch body 12 (i.e., disposed within the one or more internal cavities 76 formed by the two or more internal surfaces 74 of the switch body 12). As illustrated in FIG. 2, the secondary arm 38 may have a base portion 106 and an arm portion 108 that extends from the base portion 106. Specifically, the base portion 106 may extend from the first end 40 of the secondary arm 38 towards the second end 42 of the secondary arm 38 to a point about 10% to 50% of the total distance (along an axis parallel to the body axis 14) between the first end 40 of the secondary arm 38 and the second end 42 of the secondary arm 38. The arm portion 108 may extend from the base portion 106 to the second end 42 along an axis that is parallel to the body axis 14. A width (a distance normal to the direction of the body axis 14) of the base portion 106 may be greater than a width of the arm portion 108.

The secondary contact 44 may be disposed at or adjacent to the first end 40 of the secondary arm 38 on the base portion 106, and the secondary contact 44 of the secondary arm 38 may face and be generally aligned with the second contact 66 of the actuator assembly 46 such that the second contact 66 of the actuator assembly 46 engages or is in contact with the secondary contact 44 in the second switch position of FIG. 4. The secondary contact 44 may have the shape of a raised cylinder that extends from the base portion 106 in a direction normal to the body axis 14. The secondary contact 44 may be made from a conductive metal, and may be made from the same material as the common contact 28. The secondary contact 44 may be secured to the secondary arm 38 in any manner known in the art, such as soldering or mechanical fastening. Alternatively, the secondary contact 44 may be integrally formed with the secondary arm 38 (e.g., with the base portion 106) at or adjacent to the first end 40 of the secondary arm 38. As illustrated in FIG. 3, the secondary arm 38 may be secured to a portion of the switch body 12 (e.g., a portion of the second portion 12*b*) such that the second contact 66 of the actuator assembly 46 engages or is in contact with the secondary contact 44 of the secondary arm 38 in the second switch position (illustrated in FIG. 4). So secured, the secondary arm 38 cannot displace relative to the switch body 12.

Referring to FIGS. 2, 3, 4, 5A, 5B, and 6, the magnetically-triggered proximity switch 10 also includes the actuator assembly 46 disposed within the switch body 12 (i.e., disposed within the one or more internal cavities 76 formed by the two or more internal surfaces 74 of the switch body 12). Referring to FIG. 6, the actuator assembly 46 includes the actuator body 48 that extends along the actuator axis 50 from the first end 52 to the second end 54. The actuator body 48 may be a strip of a conducting metal, such as steel, copper, or a copper alloy. The actuator body 48 may have a main portion 111 that may extend from the first end 52 to the second end 54, and main portion 111 may be planar or substantially planar. In some embodiments, the main portion 111 have a curved cross-sectional shape that may generally extend along the actuator axis 50 (when viewed along the pivot axis 70), and the actuator axis 50 in such an embodiment may be disposed through a midpoint of the main portion 111. The main portion 111 may include a top surface 110 and a bottom surface 112 opposite the top surface 110. The actuator body 48 may include a downwardly extending first end wall 114 that may extend from the bottom surface 112 of the main portion 111 of the actuator body 48 in a direction normal to the actuator axis at (or from) the first end 52 of the actuator body 48. The actuator body 48 may additionally include a downwardly extending second end wall 116 that may extend from the bottom surface 112 of the main portion 111 of the actuator body 48 in a direction normal to the actuator axis 50 at (or from) the second end 54 of the actuator body 48, and the first end wall 114 may be parallel (or substantially parallel) to the second end wall 116.

Referring to FIG. 6, the center contact 56 is coupled to the actuator body 48 (e.g., the main portion 111 of the actuator body 48) and disposed along the actuator axis 50. The center contact axis 58 may extend through the center point 60 of the center contact 56, and the center point 60 may be disposed on a contact surface 118 of the center contact 56. The center contact axis 58 may be normal to the actuator axis 50. The center point 60 may be midway between the first end 52 and the second end 54 of the actuator body 48. The contact surface 118 may be planar or substantially planar, or may have a slightly curved or domed shape. The center contact 56 may be disposed on the top surface 110 of the actuator body 48. That is, the contact surface 118 may be at or offset from the top surface 110 of the actuator body 48, and the contact surface 118 may face the common contact 28 of the common arm 22 such that the top portion of the common contact 28 contacts or engages all or a portion of the contact surface 118. The center contact 56 may be made from a conductive metal, such as copper or a copper alloy, and the center contact 56 may be secured to the actuator body 48 in any manner known in the art, such as soldering or mechanical fastening. For example, a portion of the center contact 56 may be disposed in an aperture formed in the center of the actuator body 48. Alternatively, the center contact 56 may be integrally formed with actuator body 48.

As illustrated in FIG. 6, the first contact 62 is coupled to the actuator body 48 (e.g., the main portion 111 of the actuator body 48) and disposed along the actuator axis 50, and the first contact 62 may be disposed at or adjacent to the first end 52 of the actuator body 48. A first contact axis 120 may extend through the center point 64 of the first contact 62, and the center point 64 may be disposed on a contact surface 122 of the first contact 62. The first contact axis 120 may be parallel to the center contact axis 58 and may be normal to the actuator axis 50. The center point 64 of the first contact 62 is disposed the first distance D1 (along the actuator axis 50) from the center point 60 of the center contact 56, and the first contact axis 120 may be separated from the center contact axis 58 (along the actuator axis 50) by the first distance D1. The contact surface 122 may be planar or substantially planar, or may have a slightly curved or domed shape. The first contact 62 may be disposed on the bottom surface 112 of the actuator body 48. That is, the contact surface 122 may be at or offset from the bottom surface 112 of the actuator body 48, and as illustrated in FIG. 3, the contact surface 122 may face the primary contact 36 of the primary arm 30 such that the primary contact 36 contacts or engages all or a portion of the contact surface 122 when the actuator assembly 46 is in the first switch position. The first contact 62 may be made from a conductive metal, such as copper or a copper alloy, and the first contact 62 may be secured to the actuator body 48 in any manner known in the art, such as soldering or mechanical fastening. For example, a portion of the first contact 62 may be disposed in an aperture formed in a portion of the actuator body 48 at or adjacent to the first end 52. Alternatively, the first contact 62 may be integrally formed with actuator body 48.

Referring again to FIG. 6, the second contact 66 is coupled to the actuator body 48 (e.g., the main portion 111 of the actuator body 48) and disposed along the actuator axis 50, and the second contact 66 may be disposed at or adjacent to the first end 52 of the actuator body 48. A second contact axis 124 may extend through the center point 68 of the second contact 66, and the center point 68 may be disposed on a contact surface 126 of the second contact 66. The second contact axis 124 may be parallel to the center contact axis 58 and may be normal to the actuator axis 50. The center point 68 of the second contact 66 is disposed the second distance D2 (along the actuator axis 50) from the center point 60 of the center contact 56, and the second contact axis 124 may be separated from the center contact axis 58 (along the actuator axis 50) by the second distance D2. The second distance D2 may be equal to or approximately equal to the first distance D1. In addition, the second contact axis 124, the first contact axis 120, and the center contact axis 58 may all intersect or be disposed on the actuator axis 50. However, in some embodiments, one or more of the second contact axis 124, the first contact axis 120, and the center contact axis 58 may be offset from the actuator axis 50.

The contact surface 126 may be planar or substantially planar, or may have a slightly curved or domed shape. The second contact 66 may be disposed on the bottom surface 112 of the actuator body 48. That is, the contact surface 126 may be at or offset from the bottom surface 112 of the actuator body 48, and as illustrated in FIG. 4, the contact surface 126 may face the secondary contact 44 of the secondary arm 38 such that the secondary contact 44 contacts or engages all or a portion of the contact surface 126 when the actuator assembly 46 is in the second switch position. The second contact 66 may be made from a conductive metal, such as copper or a copper alloy, and the second contact 66 may be secured to the actuator body 48 in any manner known in the art, such as soldering or mechanical fastening. For example, a portion of the second contact 66 may be disposed in an aperture formed in a portion of the actuator body 48 at or adjacent to the first end 52. Alternatively, the second contact 66 may be integrally formed with actuator body 48.

Figure 5A:
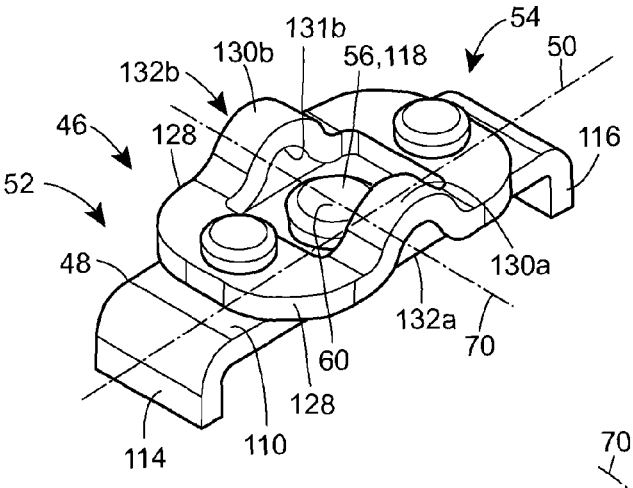
FIG. 5A is a top perspective view of an embodiment of an actuator assembly.
Figure 6:
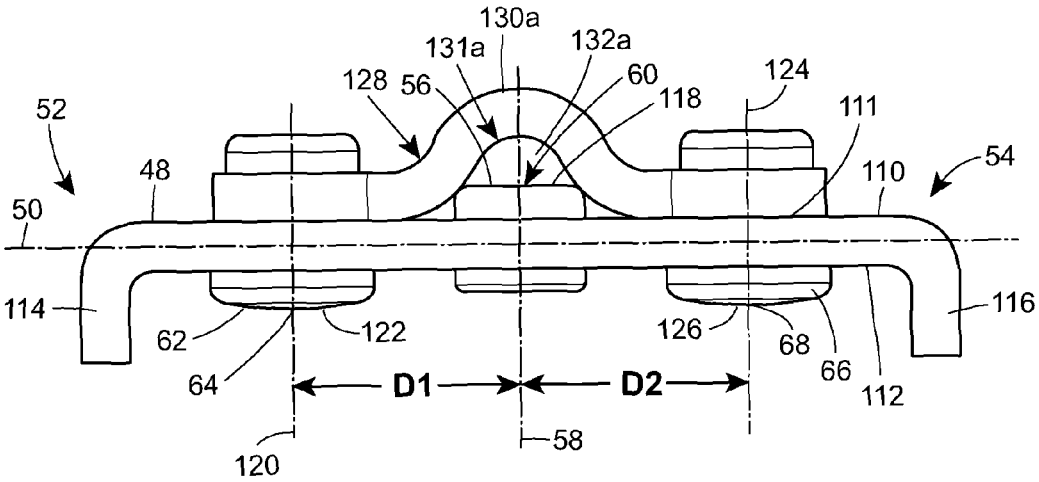
FIG. 6 is a side view of the embodiment of the actuator assembly of FIG. 5A.

As illustrated in FIG. 5A, the actuator assembly 46 may also include a support member 128 secured to the actuator body 48. The support member 128 may be coupled to or formed with the actuator body 48 to allow the actuator assembly 46 to pivot about the pivot axis 70 from the first switch position (illustrated in FIG. 3) to the second switch position (illustrated in FIG. 4), and vice versa. The support member 128 may be made from any suitable material, such as a non-conducting material (e.g., a plastic material). In some embodiments, the support member may be made from brass. As illustrated in FIG. 5A, the support member 128 may be secured to the top surface 110 of the actuator body 48. The support member 128 may be coupled to the actuator body 48 in any manner known in the art, such as soldering or mechanical fastening. For example, a portion of the first contact 62 may secure a first portion of the support member 128 to a first portion of the actuator body 48, and a portion of the second contact 66 may secure a second portion of the support member 128 to a second portion of the actuator body 48

Figure 5B:
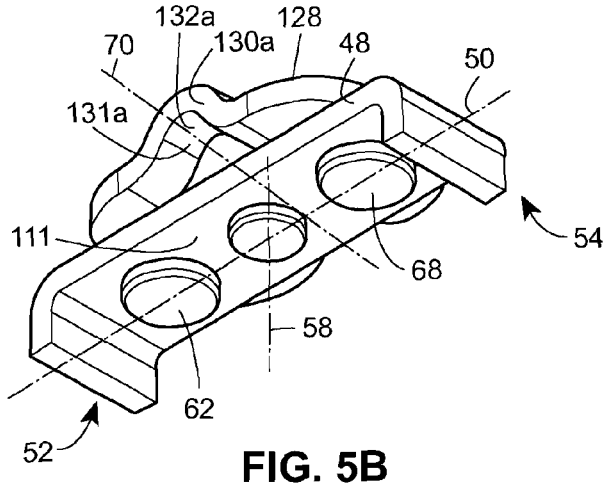
FIG. 5B is a bottom perspective view of the embodiment of the actuator assembly of FIG. 5A.
Figure 7A:
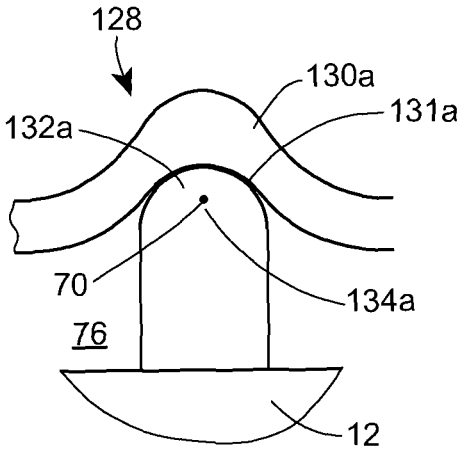
FIG. 7A is a partial side view of a portion of the support member of the actuator assembly and a first pivot member of the switch body.

Referring to FIG. 5A, the support member 128 may include a first collar portion 130*a* and a second collar portion 130*b*. As illustrated in FIG. 5B, the first collar portion 130*a* may have a first contact surface 131*a* that defines a first channel 132*a*, and as illustrated in FIG. 5A, the second collar portion 130*b* may have a second contact surface 131*a* that defines a second channel 132*a*. The first collar portion 130*a* and the second collar portion 130*b* (and each of the corresponding channels 132*a*, 132*b*) may be symmetrically formed about the actuator axis 50, and the first and second channels 132*a*, 132*b* may each extend along the pivot axis 70. As illustrated in FIG. 7A, the first channel 132*a* receives a top portion of a first pivot member 134*a*. The top portion of the first pivot member 134*a* may have a shape that corresponds to the shape of the first contact surface 131*a* such that the first collar portion 130*a* (and the entire actuator assembly 46) rotates relative to the first pivot member 134*a* about the pivot axis 70. For example, the top portion of the first pivot member 134*a* and the first contact surface 131*a* may each have the shape of a portion of a circle. With the support member 128 coupled to the actuator body 48, the actuator assembly 46 may be symmetrical about a plane extending through the center contact axis 58 and the actuator axis 50.

The first pivot member 134*a* and the second pivot member 134*b* may each be positioned such that the actuator assembly may pivot or rotate about the pivot axis 70 from the first switch position of FIG. 3 to the second switch position of FIG. 4. In some embodiments, the pivot axis 50 may be normal to the actuator axis 50. In addition, the pivot axis 70 may be normal to the body axis 14. Also, when the actuator assembly 46 is midway between the first position and the second position (i.e., when the actuator axis 50 is parallel to the body axis 14), the center contact axis 58 may intersect the pivot axis 70.

Figure 7B:
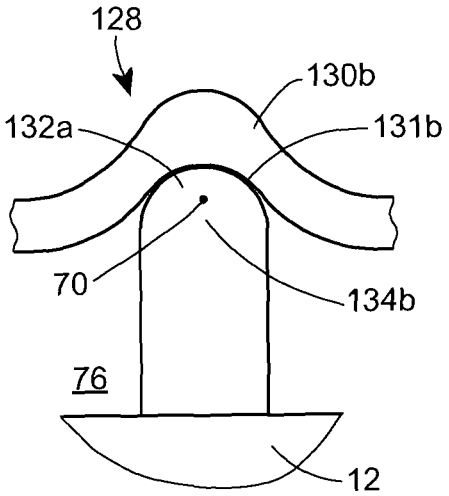
FIG. 7B is a partial side view of a portion of the support member of the actuator assembly and a second pivot member of the switch body.

Referring to FIG. 7B, the second channel 132*b* receives a top portion of a second pivot member 134*b*. The top portion of the second pivot member 134*b* may have a shape that corresponds to the shape of the second contact surface 131*b* such that the second collar portion 130*b* (and the entire actuator assembly 46) rotates relative to the second pivot member 134*b* about the pivot axis 70. For example, the top portion of the second pivot member 134*b* and the second contact surface 131*b* may each have the shape of a portion of a circle.

As illustrated in FIG. 2, the first pivot member 134*a* and the second first pivot member 134*a* may each be projections formed or disposed within the switch body 12 (i.e., formed or disposed within the one or more internal cavities 76 of the switch body 12). The first pivot member 134*a* and the second first pivot member 134*a* may extend normal to the body axis 14 from an internal surface 74 of the second portion 12*b* of the switch body 12. The first pivot member 134*a* and the second first pivot member 134*a* may be integrally formed with the switch body 12 or may be coupled to the switch body 12. The first pivot member 134*a* and the second first pivot member 134*a* may be made from any suitable material, such as a non-conducting material (e.g., a plastic material).

The support member 128 may be any structure coupled to or formed with the actuator body 48 that allows the actuator assembly 46 to pivot about the pivot axis 70 from the first switch position of FIG. 3 to the second switch position of FIG. 4, and vice versa. For example, other embodiments of the support member 128 may include first and second pins (not shown) that each extends along the pivot axis 70 and is each received into corresponding channel or aperture (not shown) formed within the switch body 12.

In operation, the magnet 20 of the magnetically-triggered proximity switch 10 may be adjusted about the magnet axis 77 to bias the actuator assembly 46 in the first switch position of FIG. 3. Specifically, the magnet 20 may be positioned such that a magnetic force acting on the first end 52 of the actuator body 48 is greater than a magnetic force acting on the second end 54 of the actuator body 48, thereby biasing or rotating the actuator assembly 46 about the pivot axis 70 into the first switch position. In this first switch position, the center contact 56 is in contact with the common contact 28 and the first contact 62 is in contact with the primary contact 36, thereby completing a circuit between the common arm 22 and the primary arm 30. Accordingly, the closed circuit that results from the first switch position can be detected by a processor that is operatively connected to the second end 26 of the common arm 22 and the second end 34 of the primary arm 30. In the first switch position, the second contact 66 is offset from and is not in contact with the secondary contact 34.

Figure 8:
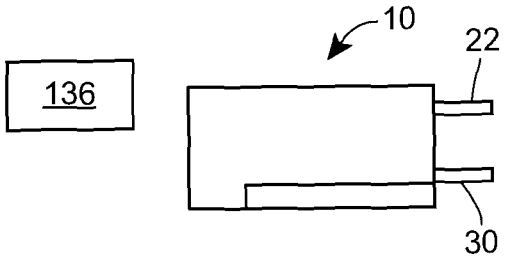
FIG. 8 is a side view of an embodiment of a magnetically-triggered proximity switch and an embodiment of a magnetic target.

However, as illustrated in FIG. 8, when a magnetic target 136, which may include a permanent magnet or a ferrous metal, is moved into a position within a predetermined operational range of the proximity switch 10, the target 136 may cause variations in a magnetic field adjacent to the actuator assembly 46, which causes the actuator assembly 46 to pivot about the pivot axis 70 from the first switch position to the second switch position illustrated in FIG. 4. For example, the magnetic force between the target 136 and the actuator body 48 (e.g., a portion of the first end 52 of the actuator body 48) may be greater than the magnetic force between the actuator body 48 and the magnet 20 (e.g., between a portion of the first end 52 of the actuator body 48). The greater force pivots the actuator assembly 46 from the first switch position to the second switch position. In the second switch position, the center contact 56 is in contact with the common contact 28 and the second contact 66 is in contact with the secondary contact 34, thereby completing a circuit between the common arm 22 and the secondary arm 38. Accordingly, the closed circuit that results from the second switch position can be detected by the processor that is operatively connected to the second end 26 of the common arm 22 and the second end 42 of the secondary arm 30. In the second switch position, the first contact 62 is offset from and is not in contact with the primary contact 36. When the magnetic target 136 is no longer within the predetermined operational range of the proximity switch 10, the magnetic field adjacent to the actuator assembly 46 may return to its original state, which causes the actuator assembly 46 to pivot about the pivot axis 70 from the second switch position back to the firsts switch position.

Figure 9A:
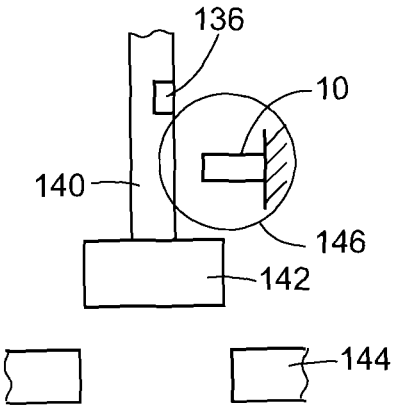
FIG. 9A is a partial side view of an embodiment of a magnetically-triggered proximity switch and an embodiment of a magnetic target secured to a valve stem coupled to a closure member of a control valve, with the closure member in an open position.
Figure 9B:
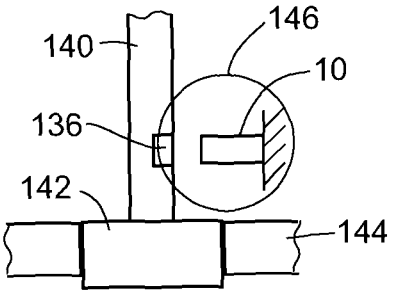
FIG. 9B is a partial side view of an embodiment of the magnetically-triggered proximity switch and the embodiment of the magnetic target secured to the valve stem of FIG. 9A, with the closure member in a closed position.

As illustrated in FIG. 9A, the magnetic target 136 may be coupled to a displaceable valve stem 140 coupled to a closure member 142 of a control valve 144, and the magnetically-triggered proximity switch 10 may be fixed to (or near) the control valve such that the magnetically-triggered proximity switch 10 remains stationary relative to the magnetic target 136. When the valve closure member 142 is in a first operation position (such as an open position of FIG. 9A), the magnetic target 136 may be outside of the operational range 146 of the magnetically-triggered proximity switch 10, and the actuator assembly 46 remains in the first switch position of FIG. 3. However, when the valve closure member 142 displaces into a second operation position (such as a closed position of FIG. 9B), the magnetic target 136 may be within the operational range 146 of the magnetically-triggered proximity switch 10, and the actuator assembly 46 may pivot into the second switch position of FIG. 4. As previously explained, an alert can then be sent to an operator or an automated operation system.

As previously explained, the common arm 22 may be secured to a portion of the switch body 12 at a portion 100 of the common arm 22 between the first end 24 and the second end 26. So secured, the common arm 22 may act as a leaf spring, and may be positioned such that a biasing force is applied by the common arm 22 to bias the common contact 28 into engagement (or contact with) the center contact 56 of the actuator assembly 46. More specifically, the first end 24 of the common arm 22 may flex in a direction normal to an axis extending from the first end 24 to the second end 26 of the un-flexed common arm 22 (or in a direction normal to the body axis 14 and/or the pivot axis 70) when a force is applied to the first end 24 (or the common contact 28) in a direction normal to the axis extending from the first end 24 to the second end 26 of the un-flexed common arm 22 (or in a direction normal to the body axis 14 and/or the pivot axis 70). The force on the common contact 28 may be provided by engagement with the center contact 56 of the actuator assembly 46, and the actuator assembly 46 may be positioned relative to the switch body 12 such that the center contact 56 engages the common contact 28 to deflect the first end 24 of the common arm 22. The biasing force on the common contact 28 directed into the center contact 56 of the actuator assembly 46 acts in a direction that extends through (or in close proximity to) the pivot axis 70. Therefore, the moment needed to pivot the actuator assembly 46 about the pivot axis 70 from the first switch position to the second switch position and vice versa is minimized (i.e., a "zero moment"), thereby eliminating or minimizing breaking torque. Accordingly, current is conducted from the common arm 22 to the primary arm 30 or from the common arm 22 to the secondary arm 38 without the use of a flexing conductor that could be damaged by constant displacement or that is too stiff to adequately bend for smaller applications.

While the magnetically-triggered proximity switch 10 has been described as a single-pole-double-throw (SPDT) switch, one having ordinary skill in the art would recognize that other configurations are possible. For example, more than one actuator assembly 46 may be disposed within the switch body 12 to comprise a double-pole-double-throw (DPDT) switch.

While various embodiments have been described above, this disclosure is not intended to be limited thereto. Variations can be made to the disclosed embodiments that are still within the scope of the appended claims.

What is claimed is:

1. A magnetically-triggered proximity switch comprising:

a switch body extending along a body axis from a first end to a second end;

a magnet secured to a portion of the switch body;

a common arm having a first end and a second end, the first end being disposed within the switch body, and the first end including a common contact;

a primary arm having a first end and a second end, the first end being disposed within the switch body, and the first end including a primary contact;

a secondary arm having a first end and a second end, the first end being disposed within the switch body, and the first end including a secondary contact;

an actuator assembly disposed within the switch body, the actuator assembly including:

an actuator body extending along an actuator axis from a first end to a second end;

a center contact coupled to the actuator body and disposed along the actuator axis, wherein a center contact axis extends through a center point of the center contact;

a first contact coupled to the actuator body and disposed along the actuator axis, wherein a center point of the first contact is disposed a first distance from the center point of the center contact, a second contact coupled to the actuator body and disposed along the actuator axis, wherein a center point of the second contact is disposed a second distance from the center point of the center contact, wherein the actuator assembly is pivotable between a first switch position and a second switch position, the actuator assembly being pivotable about a pivot axis, wherein in the first switch position, the center contact is in contact with the common contact and the first contact is in contact with the primary contact, thereby completing a circuit between the common arm and the primary arm, and wherein in the second switch position, the center contact is in contact with the common contact and the second contact is in contact with the secondary contact, thereby completing a circuit between the common arm and the secondary arm.

2. The magnetically-triggered proximity switch of claim 1, wherein the first distance is equal to the second distance.

3. The magnetically-triggered proximity switch of claim 1, wherein the common arm is a leaf spring, and a deflection of the common arm provides a biasing force that biases the common contact into engagement with the center contact of the actuator assembly.

4. The magnetically-triggered proximity switch of claim 1, wherein the actuator body has a top surface and a bottom surface, and the center contact is disposed on the top surface and the first contact and the second contact are disposed on the bottom surface.

5. The magnetically-triggered proximity switch of claim 4, further comprising a support member secured to the top surface of the actuator body, the support member including a first collar portion and a second collar portion, the first collar portion having a first contact surface that defines a first channel, the first channel receiving a top portion of a first pivot member of the switch body, and the second collar portion having a second contact surface that defines a second channel, the second channel receiving a top portion of a second pivot member of the switch body.

6. The magnetically-triggered proximity switch of claim 1, wherein in the first switch position, the second contact is not in contact with the secondary contact, and wherein in the second switch position, the first contact is not in contact with the primary contact.

7. The magnetically-triggered proximity switch of claim 1, wherein the common contact has a dome shape, with a top portion of the dome shape contacting a portion of a contact surface of the center contact of the actuator assembly.

8. The magnetically-triggered proximity switch of claim 1, wherein the actuator axis is normal to the pivot axis.

9. The magnetically-triggered proximity switch of claim 1, wherein the actuator axis extends through an axis extending through the center point of the center contact, an axis extending through the center point of the first contact, and an axis extending through the center point of the second contact.

10. The magnetically-triggered proximity switch of claim 1, wherein the second end of the common arm is disposed exterior to the switch body, the second end of the primary arm is disposed exterior to the switch body, and the second end of the secondary arm is disposed exterior to the switch body, and wherein the second end of the common arm, the second end of the primary arm, and the second end of the secondary arm extend from an end surface of the switch body that is adjacent to or at the second end of the switch body.

11. The magnetically-triggered proximity switch of claim 1, wherein the body axis is normal to the pivot axis.

12. The magnetically-triggered proximity switch of claim 1, wherein the magnet biases the actuator assembly in the first switch position.

13. The magnetically-triggered proximity switch of claim 1, further comprising:

a target disposed exterior to the switch body, the target adapted to generate a magnetic field that cause the actuator assembly to pivot from the first switch position to the second switch position.

14. The magnetically-triggered proximity switch of claim 13, wherein the target is secured to a valve stem of a control valve.

15. The magnetically-triggered proximity switch of claim 1, wherein the magnet is displaceable relative the switch body along an axis parallel to the body axis.

16. A method of assembling a magnetically-triggered proximity switch, the magnetically-triggered proximity switch including an actuator assembly including: an actuator body extending along an actuator axis from a first end to a second end; a center contact coupled to the actuator body and disposed along the actuator axis, wherein a center contact axis extends through a center point of the center contact; a first contact coupled to the actuator body and disposed along the actuator axis, wherein a center point of the first contact is disposed a first distance from the center point of the center contact; and a second contact coupled to the actuator body and disposed along the actuator axis, wherein a center point of the second contact is disposed a second distance from the center point of the center contact, the method comprising:

disposing the actuator assembly within a switch body, the actuator assembly being pivotable about a pivot axis between a first switch position and a second switch position, wherein in the first switch position, the center contact is in contact with a common contact of a common arm coupled to the switch body and the first contact is in contact with a primary contact of a primary arm coupled to the switch body, thereby completing a circuit between the common arm and the primary arm, and wherein in the second switch position, the center contact is in contact with the common contact and the second contact is in contact with a secondary contact of a secondary arm coupled to the switch body, thereby completing a circuit between the common arm and the secondary arm; and coupling a portion of the common arm to a portion of the switch body such that the common contact is biased into engagement with the center contact of the actuator assembly.

17. The method of claim 16, wherein the first distance is equal to the second distance.

18. The method of claim 16, wherein the common contact has a dome shape, with a top portion of the dome shape contacting a portion of a contact surface of the center contact of the actuator assembly.

19. The method of claim 16, wherein the actuator axis is normal to the pivot axis.

20. The method of claim 16, further comprising:

securing a magnet to the switch body, the magnet biasing the actuator assembly in the first switch position, and wherein the magnet is displaceable relative to the switch body.

* * * * *